US005990768A

United States Patent [19]

Takahashi et al.

[11] Patent Number: 5,990,768

[45] Date of Patent: Nov. 23, 1999

[54] MILLIMETER WAVEGUIDE AND A CIRCUIT APPARATUS USING THE SAME

[75] Inventors: Kazuaki Takahashi, Tokyo; Mitsuo Makimoto, Yokohama, both of Japan

[73] Assignee: Matsushita Electric Industrial Co., Ltd., Osaka, Japan

[21] Appl. No.: 08/978,617

[22] Filed: Nov. 26, 1997

[30] Foreign Application Priority Data

Nov. 28, 1996 [JP] Japan ..... 8-317362

[51] Int. Cl.[6] ..... H01P 3/08; H01P 5/08

[52] U.S. Cl. ..... 333/247; 333/238; 257/664

[58] Field of Search ..... 333/26, 33, 239, 333/243, 246–248, 250; 257/664

[56] References Cited

U.S. PATENT DOCUMENTS

| | | | |
|---|---|---|---|
| 5,012,319 | 4/1991 | Dykaar et al. | 333/246 X |
| 5,138,436 | 8/1992 | Koepf | 333/247 X |
| 5,280,253 | 1/1994 | Deki et al. | 333/246 X |
| 5,303,419 | 4/1994 | Ittipiboon et al. | 333/246 X |
| 5,471,181 | 11/1995 | Park | 333/246 |
| 5,796,321 | 8/1998 | Caillat et al. | 333/247 X |

FOREIGN PATENT DOCUMENTS 6-77709 3/1994 Japan .

OTHER PUBLICATIONS

Katehi, L.P.B.; Novel Transmission Lines for the Submillimeter–Wave Region; *Proceedings of the IEEE*, vol. 80, No. 11, Nov. 1992; pp. 1771–1787.

Katehi, L.P.B. et al.; "Micromachined Circuits for Millimeter–and Sub–Millimeter–Wave Applications"; *IEEE Antennas and Propagation Magazine*, vol. 35, No. 5, Oct. 1993; pp. 9–17.

Drayton, R.F. et al.; "Development of Self–Packaged High Frequency Circuits Using Micromachining Techniques"; *IEEE Transactions On Microwave Theory and Techniques*, vol. 43, No. 9, Sep. 1995; pp. 2073–2080.

Drayton, R.F. et al.; "Micromachined Conformal Packages for Microwave and Millimeter–Wave Applications"; *IEEE MTT–S Digest*, 1995; pp. 1387–1390.

Katehi, L.P.B. et al.; "Si–Micromachining In MM–Wave Circuits"; *IEEE 1997 Topical Symposium on Millimeter Waves*, published by IEEE in 1998.

(List continued on next page.)

*Primary Examiner*—Benny T. Lee
*Assistant Examiner*—Barbara Summons
*Attorney, Agent, or Firm*—Lowe Hauptman Gopstein Gilman & Berner

[57] ABSTRACT

A millimeter waveguide is disclosed which includes: a first single crystal substrate having a groove therein; a conductor film on a surface of said groove and a surface of said first single crystal substrate connected to said surface of said groove; a second single crystal substrate covering said conductor film; and a microstrip line on a surface of said second single crystal substrate, exposed to a cavity in said groove. A protruding portion may be formed on a bottom surface of the groove. The microstrip line including foundation (nickel chromium) and conductive (gold) layers may be formed on a surface of the groove. A protruding portion may be formed on the second single crystal substrate, wherein the height of this protruding portion is less than the depth of the groove. A millimeter waveguide for a resonator is also disclosed wherein a cavity is formed in substrates with grounding conductive layers on surfaces of the cavity, a probe extending from a microstrip line on a top surface of the substrates. Similar millimeter waveguide is also disclosed wherein the probe is replaced by magnetic field coupling structure. A circuit apparatus is also disclosed which comprises the millimeter waveguide apparatus mentioned above mentioned and an active circuit fixed on the millimeter waveguide apparatus.

46 Claims, 7 Drawing Sheets

OTHER PUBLICATIONS

"A 10–15 GHz Micromachined Directional Coupler" by Robertson et al; 1996 IEEE MTT–S Digest; pp. 797–800.
Drayton R F et al: "Design of Micromachined High Frequency Circuit Components" International Journal of Microcircuits and Electronic Packaging vol. 18, No. 1, Jan. 1, 1995, pp. 19–28, XP000517150.
Katehi L P B et al: "Novel Micromachined Approaches to MMICS Using Low–Parasitic, High–Performance Transmission Media and Enviroments" 1996 IEEE MTT–S International Microwave Symposium Digest, San Francisco, Jun. 17–21, 1996, vol. 2, Jun. 17, 1996, pp. 1145–1148, XP000732545 Ranson R G (ED).

MILLIMETER WAVEGUIDE AND A CIRCUIT APPARATUS USING THE SAME

BACKGROUND OF THE INVENTION

1. Field of the Invention

This invention relates to a millimeter waveguide for transmitting millimeter waves and a circuit apparatus using the same.

2. Description of the Prior Art

A millimeter waveguide for transmitting millimeter waves is known. As a such a waveguide, a shielded membrane microstrip is disclosed in 1996 IEEE MTT-S Digest at pages 797 to 800.

FIG. 10 is a cross-sectional side view of this prior art millimeter waveguide.

Silicon dioxide 802 is formed on a silicon substrate 801 and a microstrip line 803 is formed on the silicon dioxide 802. The silicon substrate 801 is sandwiched by a carrier substrate 804 on which a metal is formed and a silicon substrate 805 subjected to micromachining processing, so that the microstrip line 803 is shielded.

SUMMARY OF THE INVENTION

The aim of the present invention is to provide an improved millimeter waveguide and an improved circuit apparatus using the same.

According to the present invention a first millimeter waveguide is provided which comprises: a first single crystal substrate having a groove therein; a conductor film to be grounded on a surface of the groove and a surface of the first single crystal substrate connecting to the surface of groove; a second single crystal substrate covering the conductor film; and a microstrip line on a surface of the second single crystal substrate, exposed to a cavity defined by the conductor film and the second crystal substrate.

In the first millimeter waveguide, the first and second single crystal substrates comprise silicon substrates.

In the first millimeter waveguide, the conductor film comprises: a first conductor layer on the first crystal substrate, covering the groove; a conductive connecting layer on the first conductor layer; a second conductor film on the conductive connecting layer extending from one edge of the groove; and a third conductor film on the conductive connecting layer extending from another edge of the groove.

In this case the first and second conducting layers comprise nickel chromium and the conductive connecting layer comprises gold.

In the first millimeter waveguide, the first single crystal substrate may further comprise a protruding portion on a bottom surface of the groove at a middle of the bottom surface, extending along the groove to confront the microstrip line, the first conducting film covering a surface of the protruding portion.

In the first millimeter waveguide, the second single crystal substrate has a via hole and the first millimeter waveguide further comprises a second microstrip line on an opposite surface of the second single crystal substrate, connecting to the microstrip line via the via hole for coupling the microstrip line to an external circuit.

In the first millimeter waveguide the microstrip line comprises a foundation layer on the surface of the second signal crystal substrate and a conductive layer on the foundation layer. In this case, the foundation layer comprises nickel chromium and the conductive layer comprises gold.

A second millimeter waveguide is provided which comprises: a first single crystal substrate; a conductor film on the first single crystal substrate; a second single crystal substrate on the second conductor film, having a groove on side of the first crystal substrate; and a microstrip line on a bottom surface of the groove.

In the second millimeter waveguide, the first and second single crystal substrates comprise silicon substrates.

In the second millimeter waveguide, the conductor film comprises: a first conductor layer on the first crystal substrate; a conductive connecting layer on the first conductor layer; and a second conductor film on the conductive connecting layer extending from one edge of the groove; a third conductor film on the conductive connecting layer extending from another edge of the groove.

In the second millimeter waveguide, the first and second conducting layers comprise nickel chromium and the conductive connecting layer comprises gold.

In the second millimeter waveguide, the microstrip line comprises a foundation layer on the bottom surface of the groove and a conductive layer on the foundation layer. In this case, the foundation layer comprises nickel chromium and the conductive layer comprises gold.

According to this invention, a third millimeter waveguide is provided which comprises: a first single crystal substrate having a groove therein; a conductor film to be grounded on a surface of the groove and a surface of the first single crystal substrate connected to the surface of the groove; a second single crystal substrate covering the second conductor film and having a protrusion toward the groove; and a microstrip line on a surface of the protrusion, exposed to a cavity defined by the conductor film and the second crystal substrate, a height of the protrusion being less than a depth of the groove.

In the third millimeter waveguide, the first and second single crystal substrates comprise silicon substrates.

In the third millimeter waveguide, the conductor film comprises: a first conductor layer on the first crystal substrate, covering the groove; a conductive connecting layer on the first conductor layer; a second conductor film on the conductive connecting layer extending from one edge of the groove; and a third conductor film on the conductive connecting layer extending from another edge of the groove.

In the third millimeter waveguide, the first and second conducting layers comprise nickel chromium and the conductive connecting layer comprises gold.

In the third millimeter waveguide, the microstrip line comprises a foundation layer on the surface of the protrusion and a conductive layer on the foundation layer. In this case, the foundation layer comprises nickel chromium and the conductive layer comprises gold.

According to this invention, a fourth millimeter waveguide is provided which comprises: a first single crystal substrate having a hollow portion therein; a first conductor film to be grounded on a surface of the hollow portion and a surface of the first single crystal substrate connecting to the surface of the hollow portion; a second conductor film covering the hollow portion and the surface of the first single crystal substrate, having a first through hole above the hollow portion; a second single crystal substrate on the second conductor film, having a second through hole connecting to the first hole; and a microstrip line on a surface of the second single crystal substrate opposite to the first crystal substrate; and a probe extending from the microstrip line through the first and second through holes, exposed to a cavity defined by the first and second conductor films.

In the fourth millimeter waveguide, the microstrip line comprises a foundation layer on the surface of the second single crystal substrate and a conductive layer on the foundation layer. In this case, the foundation layer comprises nickel chromium and the conductive layer comprises gold.

According to this invention, a fifth millimeter waveguide is provided which comprises: a first single crystal substrate having a groove therein; a first single crystal substrate having a hollow portion therein; a first conductor film to be grounded on a surface of the hollow portion and a surface of the first single crystal substrate connecting to the surface of the hollow portion; a second conductor film covering the hollow portion and the surface of the first single crystal substrate, having a slot above the hollow portion; a second single crystal substrate on the second conductor film; and a microstrip line on a surface of the second single crystal substrate opposite to the first crystal substrate, confronting a cavity defined by the first and second conductor films through the slot and the second single crystal substrate to electromagnetically couple to the cavity.

In the fifth millimeter waveguide, the microstrip line comprises a foundation layer on the surface of the second signal crystal substrate and a conductive layer on the foundation layer. In this case, the foundation layer comprises nickel chromium and the conductive layer comprises gold.

According to this invention, a first circuit apparatus is provided which comprises: a millimeter waveguide including a first single crystal substrate having a groove therein, a conductor film to be grounded on a surface of the groove and a surface of the first single crystal substrate connecting to the surface of groove, a second single crystal substrate covering the conductor film and having a via hole, a first microstrip line on a surface of the second single crystal substrate, exposed to a cavity defined by the conductor film and the second crystal substrate, a second microstrip line on an opposite surface of the second single crystal substrate, connecting to the first microstrip line via the via hole, and a third microstrip line on the opposite surface apart from the second microstrip line; an active circuit chip for performing a predetermined circuit operation; and a connecting portion for mechanically and electrically connecting the active circuit to the third microstrip line and to the second microstrip line, wherein there is a responsive relation between the first and third microstrip lines through the active circuit, the second microstrip line, and the via hole. The connecting portion comprises micro-bumps through a flip-chip bonding.

In the first circuit apparatus, the first microstrip line comprises a foundation layer on the surface of the second signal crystal substrate and a conductive layer on the foundation layer. In this case, the foundation layer comprises nickel chromium and the conductive layer comprises gold.

According to this invention, a second circuit apparatus is provided which comprises: a millimeter waveguide including a first single crystal substrate, a conductor film to be grounded on a surface of the first single crystal substrate, a second single crystal substrate on the second conductor film, having a groove on side of the first crystal substrate and a via hole, and a first microstrip line on a bottom surface of the groove, a second microstrip line on a surface of the second single crystal substrate opposite to the groove, connecting to the first microstrip line via the via hole; and a third microstrip line on the surface of the second signal crystal substrate apart from the second microstrip line, an active circuit chip for performing a predetermined circuit operation; and a connecting portion for mechanically and electrically connecting the active circuit to the third microstrip line and to the second microstrip line, wherein there is a responsive relation between the first and third microstrip lines through the active circuit, the second microstrip line, and the via hole. The connecting portion comprises micro-bumps through a flip-chip bonding.

In the second circuit apparatus, the first microstrip line comprises a foundation layer on the bottom surface of the groove and a conductive layer on the foundation layer. In this case, the foundation layer comprises nickel chromium and the conductive layer comprises gold.

According to this invention, a third circuit apparatus is provided which comprises: a millimeter waveguide including a first single crystal substrate having a groove therein, a conductor film to be grounded on a surface of the groove and a surface of the first single crystal substrate connecting to the surface of the groove, a second single crystal substrate covering the second conductor film and having a protrusion toward the groove and a via hole therein, and a first microstrip line on a surface of the protrusion, exposed to a cavity defined by the conductor film and the second crystal substrate, a height of the protrusion being less than a depth of the groove, a second microstrip line on a surface of the second single crystal substrate opposite to the protrusion, connecting to the first microstrip line via the via hole, and a third microstrip line on the surface of the second single crystal substrate apart from the second microstrip line; an active circuit chip for performing a predetermined circuit operation; and a connecting portion for mechanically and electrically connecting the active circuit to the third microstrip line and to the second microstrip line, wherein there is a responsive relation between the first and third microstrip lines through the active circuit, the second microstrip line, and the via hole. The connecting portion comprises micro-bumps through a flip-chip bonding.

In the third circuit apparatus, the first microstrip line comprises a foundation layer on the surface of the protrusion and a conductive layer on the foundation layer. In this case, the foundation layer comprises nickel chromium and the conductive layer comprises gold.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Hereinbelow will be described a first embodiment of this invention.

Figure 1A:
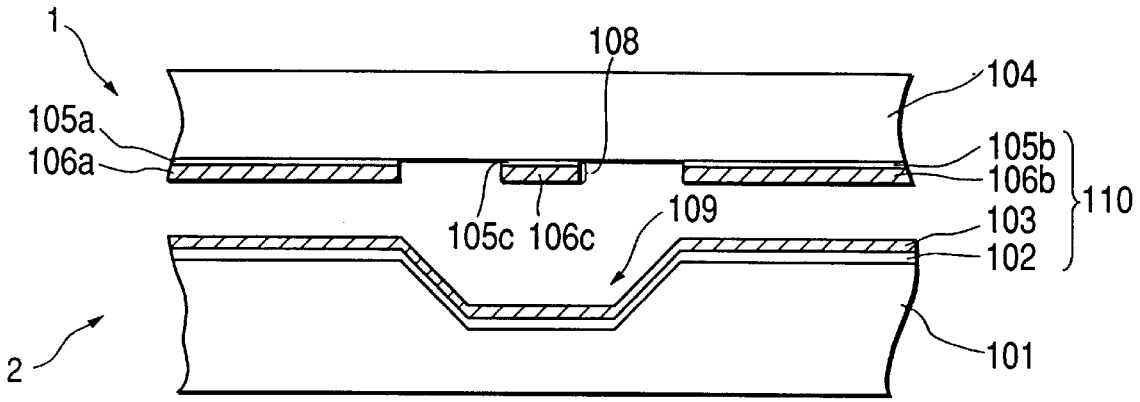
FIG. 1A is a cross-sectional side view of a millimeter waveguide of a first embodiment in a condition before connection.
Figure 1B:
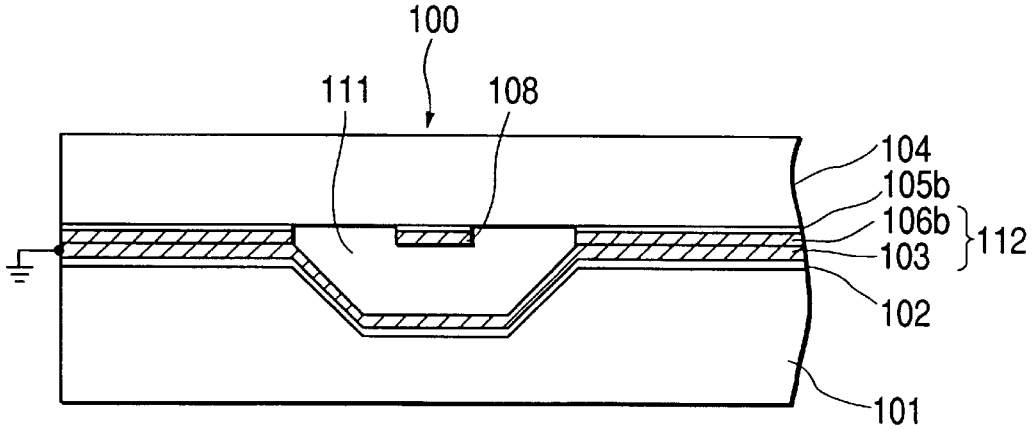
FIG. 1B is a cross-sectional side view of the millimeter waveguide of the first embodiment in a connected condition.

FIG. 1A is a cross-sectional side view of a millimeter waveguide of the first embodiment in a condition before connection. FIG. 1B is a cross-sectional side view of the millimeter waveguide of the first embodiment in a connected condition.

A millimeter waveguide 100 of the first embodiment comprises a single crystal substrate 101 having a groove 109 therein, a ground conductor film 110 on a surface of the groove 109 and a surface of the single crystal substrate 101 connecting to the surface of the groove 109, a single crystal substrate 104 covering the conductor film 110, and a microstrip line 108 on a surface of the single crystal substrate 104, exposed to a cavity 111 defined by the conductor film 110, the microstrip line 108, and the crystal substrate 104.

The single crystal substrate 101 comprises a silicon substrate. The single crystal substrate 104 comprises a silicon substrate also.

The ground conductor film 110 comprises: a conductor layer 102 on a surface of the crystal substrate 101 and a surface of the groove 109, a conductive connecting layer 112 on the conductor layer 102, a conductor film 105*a* on the conductive connecting layer 112 extending from an edge of the groove 109, and a conductor film 105*b* on the conductive connecting layer 112 extending from another edge of the groove 109.

The conductor layers 102, 105*a* and 105*b* comprise nickel chromium.

The microstrip line 108 comprises a foundation layer 105*c* on the surface of the second signal crystal substrate 104 and a conductive layer 106*c* on the foundation layer 105*c*. In this case, the foundation layer 105*c* comprises nickel chromium and the conductive layer 106*c* comprises gold.

The conductive connecting layer 112 comprises gold.

The groove 109 is formed in the single crystal substrate 101 made of a silicon by anisotropic etching. The conductor layer 102 made of nickel chromium is formed on the surface of the single crystal substrate 101 and a surface of the groove 109. The conductive connecting layer 103 is formed on the conductor layer 102 with gold.

The conductor layers 105*a*, 105*b*, 105*c* are formed on the surface of the single crystal substrate 104 with nickel chromium. Conductive connecting layers 106*a* and 106*b* are formed with gold. Then, both substrates 1 and 2 are connected by thermo-compression bonding.

This structure extends in the depth direction of the drawing as required.

This structure provides a microstrip line with shielding. The shield structure can reduce a loss due to radiation in the millimeter band.

Generally, it is difficult to directly form gold on the surface of the crystal substrates 101 and 104. Therefore, after forming the conductor layers 102 and 105*a* and 105*b*, the gold is formed on the conductor layers 102 and 105*a*, 105*b*, and 105*c*. In this structure, almost all of current flows through the microstrip line 108 on the side near the bottom surface of the ground conductor film 110 (the groove 109), that is, almost all of the current flows through the microstrip line 108 made of gold not through the foundation layer 105*c* made of nickel chromium, so that a loss can be reduced.

A second embodiment will be described.

Figure 2:
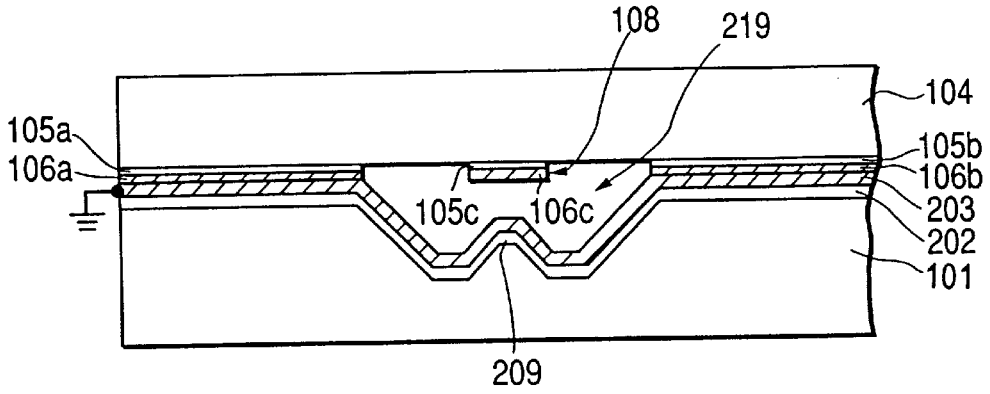
FIG. 2 is a cross-sectional side view of a millimeter waveguide of a second embodiment.

FIG. 2 is a cross-sectional side view of a millimeter waveguide of the second embodiment.

The millimeter waveguide of the second embodiment has substantially the same structure as that of the first embodiment. The difference is that a protruding portion 209 is formed on a bottom surface of the groove 219 at a middle of the bottom surface, extending along edges of the groove 219 in the depth direction of the drawing of FIG. 2. The conductor film 202 and the conductive connecting layer 203 cover a surface of the protruding portion 209.

In the structure of the first embodiment, the current concentrates on both sides of the microstrip line 108. On the other hand, in the structure of the second embodiment, the current tends to flow through the middle portion of the microstrip line 108, so that a current density can be dispersed. Then, a loss in the microstrip line 108 can be further reduced.

A third embodiment will be described.

Figure 3:
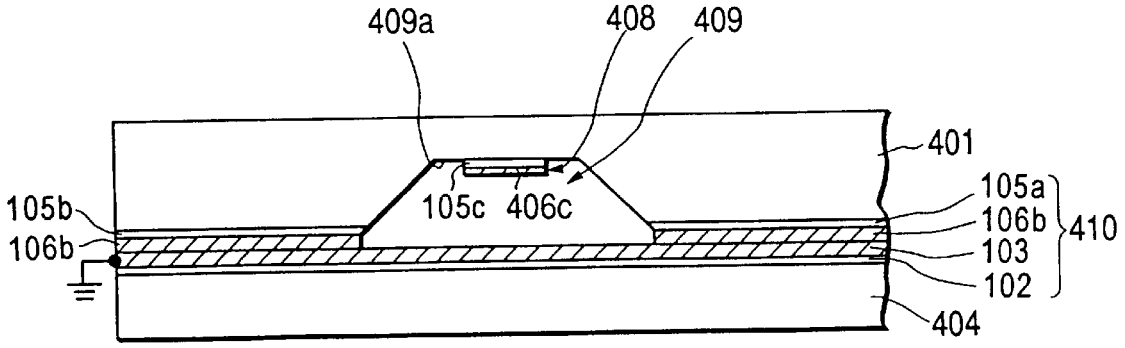
FIG. 3 is a cross-sectional side view of a millimeter waveguide of a third embodiment.

FIG. 3 is a cross-sectional side view of a millimeter waveguide of the third embodiment.

The millimeter waveguide of the third embodiment comprises: a single crystal substrate 404, a conductor film 410 on a surface of the single crystal substrate 404, a single crystal substrate 401 on the conductor film 410, having a groove 409 on the side of the crystal substrate 404, and a microstrip line 408 on a bottom surface 409*a* of the groove 409.

That is, the difference from the first embodiment is that the microstrip line 408 is formed on the bottom surface of the groove 409 instead of the crystal substrate 101. Therefore, the operation is similar to the first embodiment. However, the extent that the grounded conductor film surrounds the microstrip line is different between the first and third embodiments.

A fourth embodiment will be described.

Figure 4A:
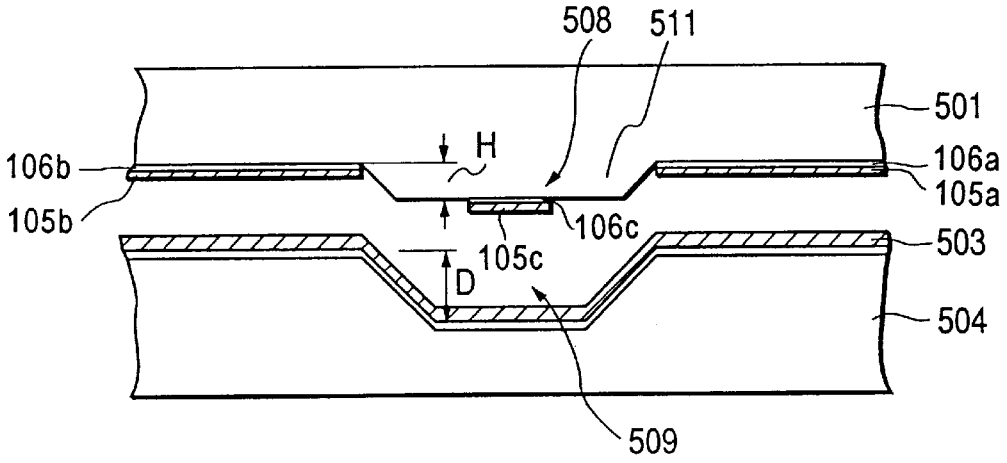
FIG. 4A is a cross-sectional side view of a millimeter waveguide of a fourth embodiment in a condition before connection.
Figure 4B:
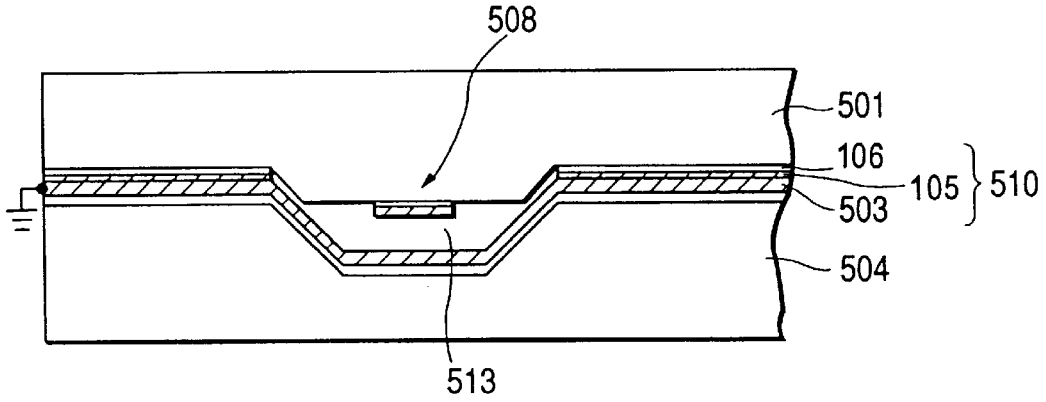
FIG. 4B is a cross-sectional side view of the millimeter waveguide of the fourth embodiment in a connected condition.

FIG. 4A is a cross-sectional side view of a millimeter waveguide of the fourth embodiment in a condition before connection. FIG. 4B is a cross-sectional side view of the millimeter waveguide of the fourth embodiment in a connected condition.

The millimeter waveguide of the third embodiment comprises a single crystal substrate 504 having a groove 509 therein, a conductor film 510 on a surface of the groove 509 and a surface of the single crystal substrate 504 connecting to the surface of the groove 509, a second crystal substrate 501 covering the conductor film 510 and the groove 509 and having a protrusion 511 toward the groove 509, and a microstrip line 508 on a surface of the protrusion 511, exposed to a cavity 513 defined by the conductor film 503 and the crystal substrate 501. A height H of the protrusion 511 is less than a depth D of the groove 509. In this embodiment, the height H is about a half of the depth D. Therefore, the protrusion 511 is formed such that the protrusion fits into the groove 509, wherein the cavity 513 is formed.

The basic operation is similar to the first embodiment. The difference is that a shielding effect is higher than that of the first embodiment because the microstrip line 508 is surrounded by the conductor film 510, so that a loss due to radiation at millimeter band can be reduced.

A fifth embodiment will be described.

Figure 5:
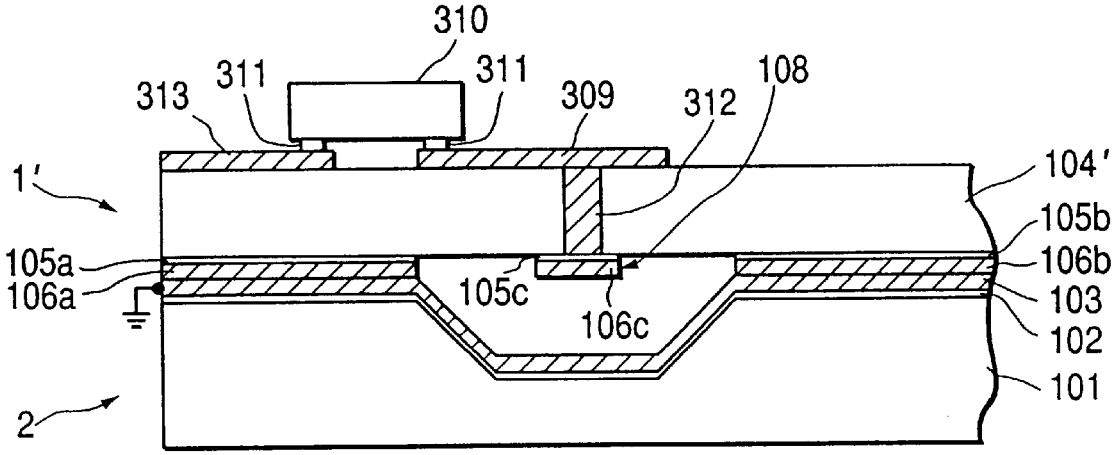
FIG. 5 is a cross-sectional side view of a circuit apparatus of a fourth embodiment using the millimeter waveguide of the first embodiment.

FIG. 5 is a cross-sectional side view of a circuit apparatus of the fourth embodiment using the structure of the millimeter waveguide 100 of the first embodiment.

The crystal substrate 104' is processed to form a via hole 312 therein and then, microstrip lines 309 and 313 are formed in addition to forming the microstrip line 108 and the conductor films 105*a* to 105*c* and the conductive connecting films 106*a* and 106*b* similarly to the first embodiment. Then, the substrates 1' and 2 are connected by the thermo compression bonding. Then, the active circuit 310 is connected to the microstrip lines 309 and 313 with micro-bumps 311 by flip chip bonding.

The microstrip line 309 on the second single crystal substrate 104' is connected to the microstrip line 108 via the via hole 312. The active circuit chip 310 performs a predetermined circuit operation, such as amplifying. The micro-bumps 311 mechanically and electrically connect the active circuit 310 to the microstrip line 313 and to the microstrip line 309. The microstrip line 313 is used for inputting an external signal to the active circuit or outputting a signal from the active circuit 310. Therefore, there is a responsive relation between the microstrip lines 108 and 313 through the active circuit 310, the via hole 312 and microstrip line 309.

The microstrip line 108 comprises the foundation layer 105*c* on the surface of the second single crystal substrate 104' and the conductive layer 106*c* on the foundation layer 105*c*. In this case, the foundation layer 105*c* comprises nickel chromium and the conductive layer 106*c* comprises gold.

A sixth embodiment will be described.

Figure 6:
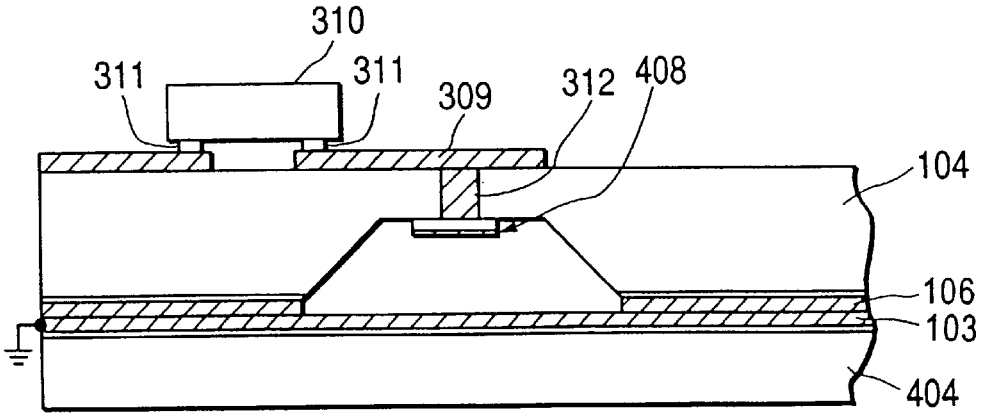
FIG. 6 is a cross-sectional side view of a circuit apparatus of a sixth embodiment using the millimeter waveguide of the third embodiment.

FIG. 6 is a cross-sectional side view of a circuit apparatus of the sixth embodiment using the millimeter waveguide of the third embodiment.

The structure of the sixth embodiment is similar to that of the fifth embodiment. The difference is that the structure of the millimeter waveguide of the third embodiment is used instead of that of the first embodiment.

A seventh embodiment will be described.

Figure 7:
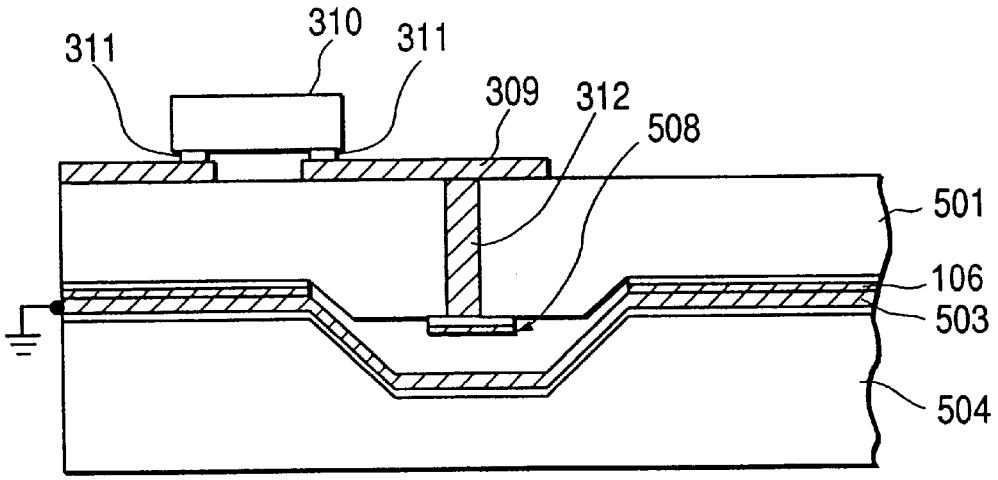
FIG. 7 is a cross-sectional side view of a circuit apparatus of a seventh embodiment using the millimeter waveguide of the fourth embodiment.
Figure 10:
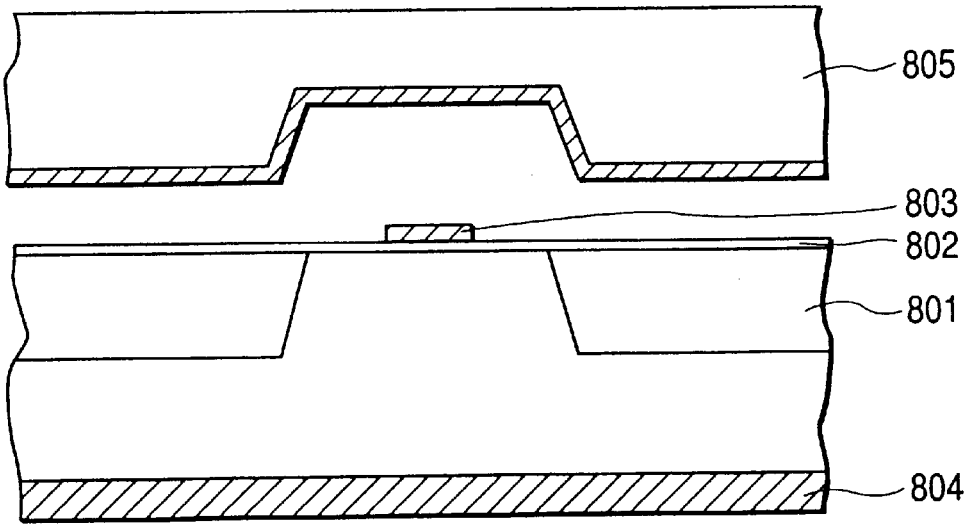
FIG. 10 PRIOR ART
FIG. 10 is a cross-sectional side view of a prior art millimeter waveguide.

FIG. 7 is a cross-sectional side view of a circuit apparatus of the seventh embodiment using the millimeter waveguide of the fourth embodiment.

The structure of the seventh embodiment is similar to that of the fifth embodiment. The difference is that the structure of the millimeter waveguide of the fourth embodiment is used instead of that of the first embodiment.

An eighth embodiment will be described.

Figure 8A:
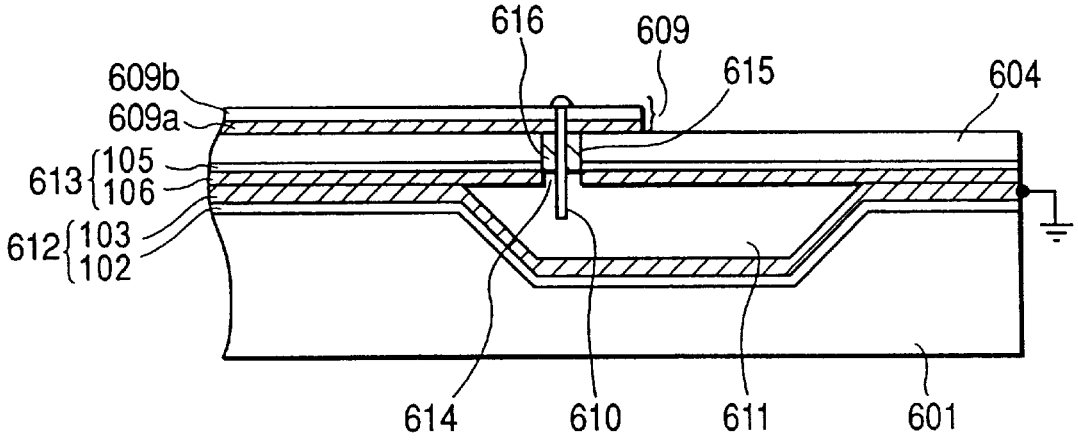
FIG. 8A is a cross-sectional side view of a millimeter waveguide apparatus of an eighth embodiment.
Figure 8B:
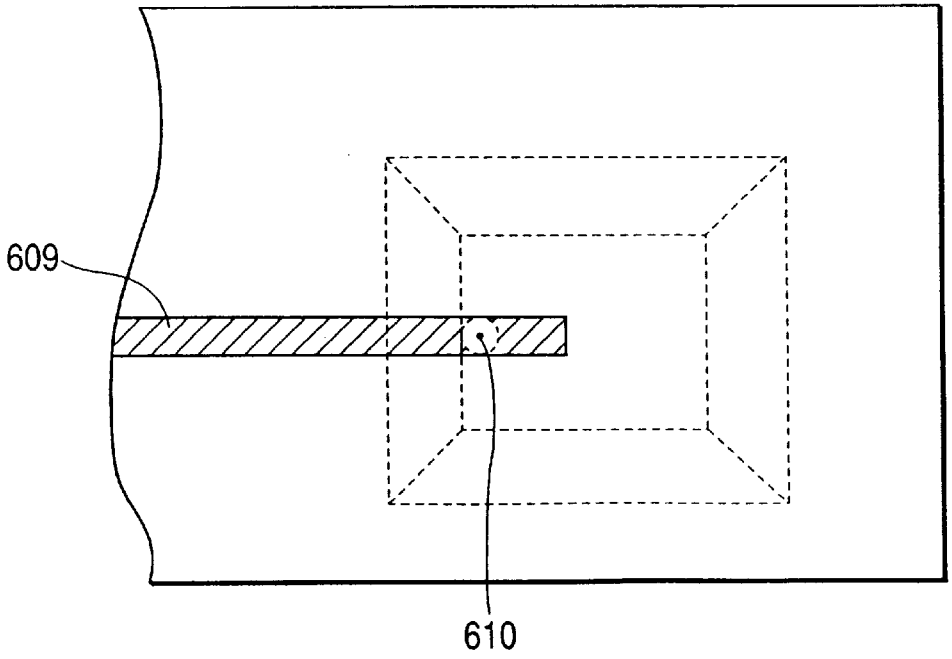
FIG. 8B is a plan view of the millimeter waveguide apparatus of the eighth embodiment.

FIG. 8A is a cross-sectional side view of a millimeter waveguide apparatus of the eighth embodiment. FIG. 8B is a plan view of the millimeter waveguide apparatus of the eighth embodiment.

A millimeter waveguide of the eighth embodiment comprises a single crystal substrate 601 having a hollow portion 611 therein, a conductor film 612 on a surface of the hollow portion 611 and a surface of the single crystal substrate 601 connecting to the surface of the hollow portion 611, a conductor film 613 covering the hollow portion 611 and the conductor film 612, having a through hole 614 above the hollow portion 611, a single crystal substrate 604 on the conductor film 613, having a through hole 615 connected to the first hole 614, and a microstrip line 609 on a surface of the second single crystal substrate 604 opposite to the crystal substrate 601, and a probe 610 extending from the microstrip line 609 through the through holes 614 and 615, exposed to a cavity (611) defined by the conductor films 612 and 613.

The probe 610 is connected to the microstrip line 609 as follows:

The probe 610 has a dielectric substance 616 surrounding the probe 610. A tip of the dielectric substance 616 is stripped and is pierced through a through hole formed in the microstrip line 609. Then, the probe 610 is soldered.

The microstrip line 609 comprises a foundation layer 609*a* on the surface of the second single crystal substrate 604 and a conductive layer 609*b* on the foundation layer. The foundation layer 609*a* comprises nickel chromium and the conductive layer 609*b* comprises gold.

A ninth embodiment will be described.

Figure 9A:
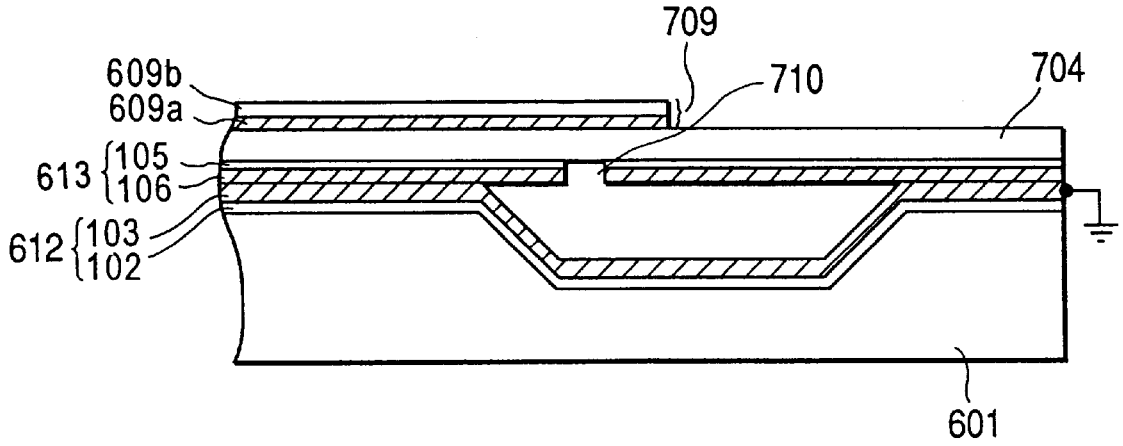
FIG. 9A is a cross-sectional side view of a millimeter waveguide apparatus of a ninth embodiment.
Figure 9B:
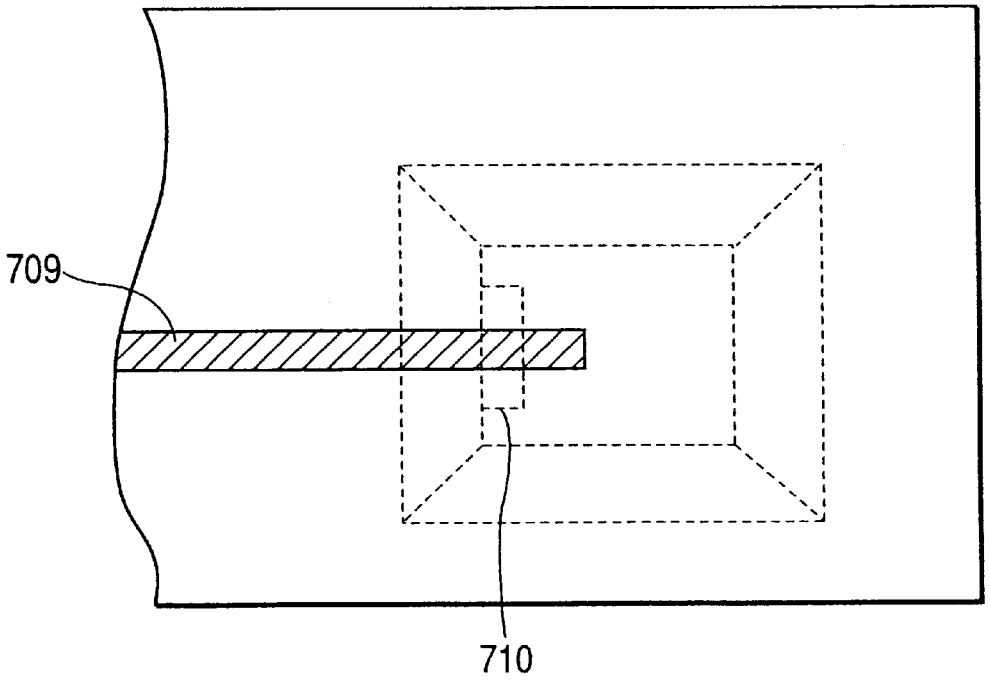
FIG. 9B is a plan view of the millimeter waveguide apparatus of the ninth embodiment.

FIG. 9A is a cross-sectional side view of a millimeter waveguide apparatus of the ninth embodiment. FIG. 9B is a plan view of the millimeter waveguide apparatus of the ninth embodiment.

A millimeter waveguide of the ninth embodiment is substantially similar to the eighth embodiment. The difference is that the through hole 615 is not formed and a slot 710 having a rectangular shape in the drawing of FIG. 9B instead the through hole 614. The microstrip line 709 is electromagnetically coupled to the cavity through the slot 710.

This structure eliminates the necessity of fixing the probe 610 to the crystal.

What is claimed is:

1. A millimeter waveguide comprising:

a first single crystal substrate having a groove therein;

a conductor film to be grounded on a surface of said groove and a surface of said first single crystal substrate connecting to said surface of groove;

a second single crystal substrate covering said conductor film; and a microstrip line on a surface of said second single crystal substrate, exposed to a cavity defined by said conductor film and said second crystal substrate;

wherein said conductor film comprises:

a first conductor layer on said first crystal substrate, covering said groove;

a conductive connecting layer on said first conductor layer;

a second conductor film on said conductive connecting layer extending from one edge of said groove; and a third conductor film on said conductive connecting layer extending from another edge of said groove.

2. A millimeter waveguide as claimed in claim 1, wherein said first single crystal substrate comprises a silicon substrate.

3. A millimeter waveguide as claimed in claim 1, wherein said second single crystal substrate comprises a silicon substrate.

4. The millimeter waveguide as claimed in claim 1, wherein said first conductor layer and said second conductor film comprise nickel chromium and said conductive connecting layer comprises gold.

5. A millimeter waveguide as claimed in claim 1, wherein said first conductor layer and said second conductor film comprise nickel chromium.

6. A millimeter waveguide as claimed in claim 1, wherein said conductive connecting layer comprises gold.

7. A millimeter waveguide as claimed in claim 1, wherein said first single crystal substrate further comprises a protruding portion on a bottom surface of said groove at a middle of said bottom surface, extending along said groove to confront said microstrip line, said first conductor layer covering a surface of said protruding portion.

8. A millimeter waveguide as claimed in claim 1, wherein said second single crystal substrate has a via hole, said millimeter waveguide further comprising a second microstrip line on an opposite surface of said second single crystal substrate, connecting to said first mentioned microstrip line via said via hole for coupling said first mentioned microstrip line to an external circuit.

9. The millimeter waveguide as claimed in claim 1, wherein said microstrip line comprises a foundation layer on said surface of said second signal crystal substrate and a conductive layer on said foundation layer.

10. The millimeter waveguide as claimed in claim 9, wherein said foundation layer comprises nickel chromium and said conductive layer comprises gold.

11. A circuit apparatus comprising: a millimeter waveguide comprising:

a first single crystal substrate having a groove therein;

a conductor film to be grounded on a surface of said groove and a surface of said first single crystal substrate connecting to said surface of groove;

a second single crystal substrate covering said conductor film and having a via hole;

a first microstrip line on a surface of said second single crystal substrate, exposed to a cavity defined by said conductor film and said second crystal substrate;

a second microstrip line on an opposite surface of said second single crystal substrate, connecting to said first microstrip line via said via hole; and a third microstrip line on said opposite surface apart from said second microstrip line;

an active circuit chip for performing a predetermined circuit operation; and connecting means for mechanically and electrically connecting said active circuit to said third microstrip line and to said second microstrip line, wherein there is a responsive relation between said first and third microstrip lines through said active circuit, said second microstrip line, and said via hole.

12. The circuit apparatus as claimed in claim 11, wherein said connecting means comprises micro-bumps.

13. The circuit apparatus as claimed in claim 11, wherein said first microstrip line comprises a foundation layer on said surface of said second signal crystal substrate and a conductive layer on said foundation layer.

14. The circuit apparatus as claimed in claim 13, wherein said foundation layer comprises nickel chromium and said conductive layer comprises gold.

15. A millimeter waveguide comprising:

a first single crystal substrate having a groove therein;

a conductor film to be grounded on a surface of said groove and a surface of said first single crystal substrate connected to said surface of said groove;

a second single crystal substrate covering said conductor film and having a protrusion toward said groove; and a microstrip line on a surface of said protrusion, exposed to a cavity defined by said conductor film and said second crystal substrate, a height of said protrusion being less than a depth of said groove.

16. A millimeter waveguide as claimed in claim 15, wherein said first single crystal substrate comprises a silicon substrate.

17. A millimeter waveguide as claimed in claim 15, wherein said second single crystal substrate comprises a silicon substrate.

18. A millimeter waveguide as claimed in claim 15, wherein said conductor film comprises:

a first conductor layer on said first crystal substrate, covering said groove;

a conductive connecting layer on said first conductor layer;

a second conductor layer on said conductive connecting layer extending from one edge of said groove; and a third conductor layer on said conductive connecting layer extending from another edge of said groove.

19. A millimeter waveguide as claimed in claim 18, wherein said first and second conductor layers comprise nickel chromium.

20. A millimeter waveguide as claimed in claim 18, wherein said conductive connecting layer comprises gold.

21. The millimeter waveguide as claimed in claim 18, wherein said first and second conductor layers comprise nickel chromium and said conductive connecting layer comprises gold.

22. The millimeter waveguide as claimed in claim 15, wherein said microstrip line comprises a foundation layer on said surface of said protrusion and a conductive layer on said foundation layer.

23. The millimeter waveguide as claimed in claim 22, wherein said foundation layer comprises nickel chromium and said conductive layer comprises gold.

24. A circuit apparatus comprising: a millimeter waveguide comprising:

a first single crystal substrate having a groove therein;

a conductor film to be grounded on a surface of said groove and a surface of said first single crystal substrate connecting to said surface of said groove;

a second single crystal substrate covering said second conductor film and having a protrusion toward said groove and a via hole therein; and a first microstrip line on a surface of said protrusion, exposed to a cavity defined by said conductor film and said second crystal substrate, a height of said protrusion being less than a depth of said groove;

a second microstrip line on a surface of said second single crystal substrate opposite to said protrusion, connecting to said first microstrip line via said via hole; and a third microstrip line on said surface of said second single crystal substrate apart from said second microstrip line; and an active circuit chip for performing a predetermined circuit operation; and connecting means for mechanically and electrically connecting said active circuit to said third microstrip line and to said second microstrip line, wherein there is a responsive relation between said first and third microstrip lines through said active circuit, said second microstrip line, and said via hole.

25. The circuit apparatus as claimed in claim 24, wherein said first microstrip line comprises a foundation layer on said surface of said protrusion and a conductive layer on said foundation layer.

26. The circuit apparatus as claimed in claim 25, wherein said foundation layer comprises nickel chromium and said conductive layer comprises gold.

27. The circuit apparatus as claimed in claim 24, wherein said connecting means comprises micro-bumps.

28. A millimeter waveguide comprising:

a first single crystal substrate;

a conductor film to be grounded on said first single crystal substrate;

a second single crystal substrate on said conductor film, having a groove on a side facing said first crystal substrate; and a microstrip line on a bottom surface of said groove.

29. A millimeter waveguide as claimed in claim 28, wherein said first single crystal substrate comprises a silicon substrate.

30. A millimeter waveguide as claimed in claim 28, wherein said conductor film comprises:

a first conductor layer on said first crystal substrate;

a conductive connecting layer on said first conductor layer; and a second conductor layer on said conductive connecting layer extending from one edge of said groove;

a third conductor layer on said conductive connecting layer extending from another edge of said groove.

31. A millimeter waveguide as claimed in claim 30, wherein said first and second conductor layers comprise nickel chromium.

32. A millimeter waveguide as claimed in claim 30, wherein said conductive connecting layer comprises gold.

33. The millimeter waveguide as claimed in claim 30, wherein said first and second conductor layers comprise nickel chromium and said conductive connecting layer comprises gold.

34. The millimeter waveguide as claimed in claim 28, wherein said microstrip line comprises a foundation layer on said bottom surface of said groove and a conductive layer on said foundation layer.

35. The millimeter waveguide as claimed in claim 34, wherein said foundation layer comprises nickel chromium and said conductive layer comprises gold.

36. A millimeter waveguide as claimed in claim 28, wherein said second single crystal substrate comprises a silicon substrate.

37. A millimeter waveguide comprising:

a first single crystal substrate having a hollow portion therein;

a first conductor film to be grounded on a surface of said hollow portion and a surface of said first single crystal substrate connecting to said surface of said hollow portion;

a second conductor film covering said hollow portion and said surface of said first single crystal substrate, having a first through hole above said hollow portion;

a second single crystal substrate on said second conductor film, having a second through hole connecting to said first hole; and a microstrip line on a surface of said second single crystal substrate opposite to said first crystal substrate; and a probe extending from said microstrip line through said first and second through holes, exposed to a cavity defined by said first and second conductor films.

38. The millimeter waveguide as claimed in claim 37, wherein said microstrip line comprises a foundation layer on said surface of said second single crystal substrate and a conductive layer on said foundation layer.

39. The millimeter waveguide as claimed in claim 38, wherein said foundation layer comprises nickel chromium and said conductive layer comprises gold.

40. A millimeter waveguide comprising:

a first single crystal substrate having a hollow portion therein;

a first conductor film to be grounded on a surface of said hollow portion and a surface of said first single crystal substrate connecting to said surface of said hollow portion;

a second conductor film covering said hollow portion and said surface of said first single crystal substrate, having a slot above said hollow portion;

a second single crystal substrate on said second conductor film; and a microstrip line on a surface of said second single crystal substrate opposite to said first crystal substrate, confronting a cavity defined by said first and second conductor films through said slot, and said second single crystal substrate to electromagnetically couple to said cavity.

41. The millimeter waveguide as claimed in claim 40, wherein said microstrip line comprises a foundation layer on said surface of said second signal crystal substrate and a conductive layer on said foundation layer.

42. The millimeter waveguide as claimed in claim 41, wherein said foundation layer comprises nickel chromium and said conductive layer comprises gold.

43. A circuit apparatus comprising: a millimeter waveguide comprising:

a first single crystal substrate;

a conductor film to be grounded on a surface of said first single crystal substrate;

a second single crystal substrate on said second conductor film, having a groove on side of said first crystal substrate and a via hole; and a first microstrip line on a bottom surface of said groove;

a second microstrip line on a surface of said second single crystal substrate opposite to said groove, connecting to said first microstrip line via said via hole; and a third microstrip line on said surface of said second signal crystal substrate apart from said second microstrip line;

an active circuit chip for performing a predetermined circuit operation; and connecting means for mechanically and electrically connecting said active circuit to said third microstrip line and to said second microstrip line, wherein there is a responsive relation between said first and third microstrip lines through said active circuit, said second microstrip line, and said via hole.

44. The circuit apparatus as claimed in claim 43, wherein said first microstrip line comprises a foundation layer on said bottom surface of said groove and a conductive layer on said foundation layer.

45. The circuit apparatus as claimed in claim 44, wherein said foundation layer comprises nickel chromium and said conductive layer comprises gold.

46. The circuit apparatus as claimed in claim 43, wherein said connecting means comprises micro-bumps.

* * * * *